US007370636B2

(12) United States Patent
Futonagane et al.

(10) Patent No.: US 7,370,636 B2
(45) Date of Patent: May 13, 2008

(54) FUEL INJECTION SYSTEM

(75) Inventors: Yoshinori Futonagane, Susono (JP); Yoshimasa Watanabe, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 15 days.

(21) Appl. No.: 11/579,058

(22) PCT Filed: Sep. 22, 2005

(86) PCT No.: PCT/JP2005/018057

§ 371 (c)(1),
(2), (4) Date: Oct. 30, 2006

(87) PCT Pub. No.: WO2006/033469

PCT Pub. Date: Mar. 30, 2006

(65) Prior Publication Data

US 2008/0029066 A1 Feb. 7, 2008

(30) Foreign Application Priority Data

Sep. 24, 2004 (JP) ..... 2004-277112
Feb. 7, 2005 (JP) ..... 2005-030275

(51) Int. Cl.
*F02M 37/04* (2006.01)
*F02M 47/02* (2006.01)

(52) U.S. Cl. ..... 123/446; 123/467; 239/92; 239/96

(58) Field of Classification Search ..... 123/446, 123/447, 467; 239/88–96
See application file for complete search history.

(56) References Cited

U.S. PATENT DOCUMENTS

| | | | | |
|---|---|---|---|---|
| 4,279,385 | A * | 7/1981 | Straubel et al. | 239/90 |
| 5,641,121 | A * | 6/1997 | Beck et al. | 239/92 |
| 6,053,421 | A * | 4/2000 | Chockley | 239/5 |
| 6,113,000 | A * | 9/2000 | Tian | 239/88 |
| 6,883,498 | B2 * | 4/2005 | Braun et al. | 123/446 |
| 6,892,703 | B2 * | 5/2005 | Magel | 123/446 |
| 6,994,272 | B2 * | 2/2006 | Kurrle et al. | 239/96 |
| 7,066,400 | B2 * | 6/2006 | Brenk et al. | 239/124 |
| 7,083,113 | B2 * | 8/2006 | Kropp et al. | 239/92 |
| 7,121,476 | B2 * | 10/2006 | Buehler et al. | 239/88 |
| 7,216,815 | B2 * | 5/2007 | Magel | 239/88 |

(Continued)

FOREIGN PATENT DOCUMENTS

JP A 55-106360 8/1980

(Continued)

*Primary Examiner*—Thomas Moulis
(74) *Attorney, Agent, or Firm*—Oliff & Berridge, PLC

(57) ABSTRACT

A fuel injector (1) in an internal combustion engine, wherein an intermediate chamber control valve (26) operated by the fuel pressure in a common rail (2) is arranged in a fuel flow passage (25) connecting a two-position switching type three-way valve (8) and an intermediate chamber (20) of a booster piston (17). When the fuel pressure in the common rail (2) is in a high pressure side fuel region, the booster piston (17) is operated by this intermediate chamber control valve (26), while when the fuel pressure in the common rail (2) is in a low pressure side fuel region, the operation of the booster piston (17) is stopped by this intermediate chamber control valve (26).

14 Claims, 12 Drawing Sheets

U.S. PATENT DOCUMENTS

| | | | | |
|---|---|---|---|---|
| 2005/0077378 | A1* | 4/2005 | Kropp et al. | 239/88 |
| 2005/0116058 | A1* | 6/2005 | Magel | 239/88 |
| 2005/0224600 | A1* | 10/2005 | Brenk et al. | 239/88 |

FOREIGN PATENT DOCUMENTS

| | | |
|---|---|---|
| JP | A 06-101591 | 4/1994 |
| JP | A 10-238432 | 9/1998 |
| JP | A 2002-202021 | 7/2002 |
| JP | A 2002-364484 | 12/2002 |
| JP | A 2003-106235 | 4/2003 |

* cited by examiner (A)

(B)

(A)

(B)

(A)

(B)

(A)

(B)

(A)

(B)

(A)

(B)

(A)

(B)

FUEL INJECTION SYSTEM

TECHNICAL FIELD

The present invention relates to a fuel injection system.

BACKGROUND ART

In a fuel injection system provided with a pressure control chamber formed on an inside end of a needle valve and with an intermediate chamber of a booster piston for increasing the injection pressure, discharging high pressure fuel in a common rail supplied into the pressure control chamber to the inside of a fuel discharge passage so as to open the needle valve and inject fuel, and discharging high pressure fuel in the common rail supplied into the intermediate chamber into the fuel discharge passage so as to operate the booster piston and increase the fuel injection pressure, known in the art is a fuel injection system designed to connect the pressure control chamber and intermediate chamber through a three-position switching type three-way valve to the fuel discharge passage and to use the switching action of this three-way valve to connect both the pressure control chamber and intermediate chamber to the fuel discharge passage when increasing the injection pressure at the time of fuel injection and connect only the pressure control chamber to the fuel discharge passage when not increasing the injection pressure at the time of fuel injection, that is, when stopping the operation of the booster piston (see Japanese Patent Publication (A) No. 2003-106235).

However, in the above-mentioned three-position switching type three-way valve, the excitation current supplied to the electromagnetic coil for driving the valve element is changed so as to make the valve element move to either one end position, an intermediate position, or another end position. In this case, electromagnetic force may theoretically be used to make the valve element stop at the intermediate position, but in actuality the valve element is extremely unstable in position. In particular, in a fuel injection system intended to be attached to a heavily vibrating engine, three-position switching type three-way valves using electromagnetic force to position the valve element at the intermediate position are currently not in favor for use. Further, if making a valve element take three positions, the amount of lift of the valve element has to be increased. To increase the amount of lift of the valve element, the electromagnetic coil has to be made considerably larger in size. However, in a fuel injector, making the electromagnetic coil larger is extremely difficult.

DISCLOSURE OF THE INVENTION

The present invention provides a fuel injection system able to use a stable two-position switching type three-way valve to control the booster action of a booster piston.

According to the present invention, there is provided a fuel injection system selectively connecting a pressure control chamber formed on an inside end of a needle valve and an intermediate chamber of a booster piston for increasing the injection pressure through a two-position switching type three-way valve to the inside of a common rail or a fuel discharge passage, discharging high pressure fuel inside the common rail supplied into the pressure control chamber into the fuel discharge passage so as to open the needle valve and inject fuel, and discharging high pressure fuel inside the common rail supplied into the intermediate chamber into the fuel discharge passage so as to operate the booster piston and increase the fuel injection pressure, wherein an intermediate chamber control valve operated by the fuel pressure in the common rail is arranged in a fuel flow passage connecting the three-way valve and intermediate chamber, and the intermediate chamber control valve controls the flow area of the fuel flow passage in accordance with the fuel pressure in the common rail to operate the booster piston when the fuel pressure in the common rail is in a high pressure side fuel region higher than a predetermined fuel pressure and to weaken the booster action by the booster piston as compared with when the fuel pressure in the common rail is in the high pressure side fuel region or stop the operation of the booster piston when the fuel pressure in the common rail is in a low pressure side fuel region lower than the predetermined fuel pressure.

BEST MODE FOR WORKING INVENTION

Figure 1:
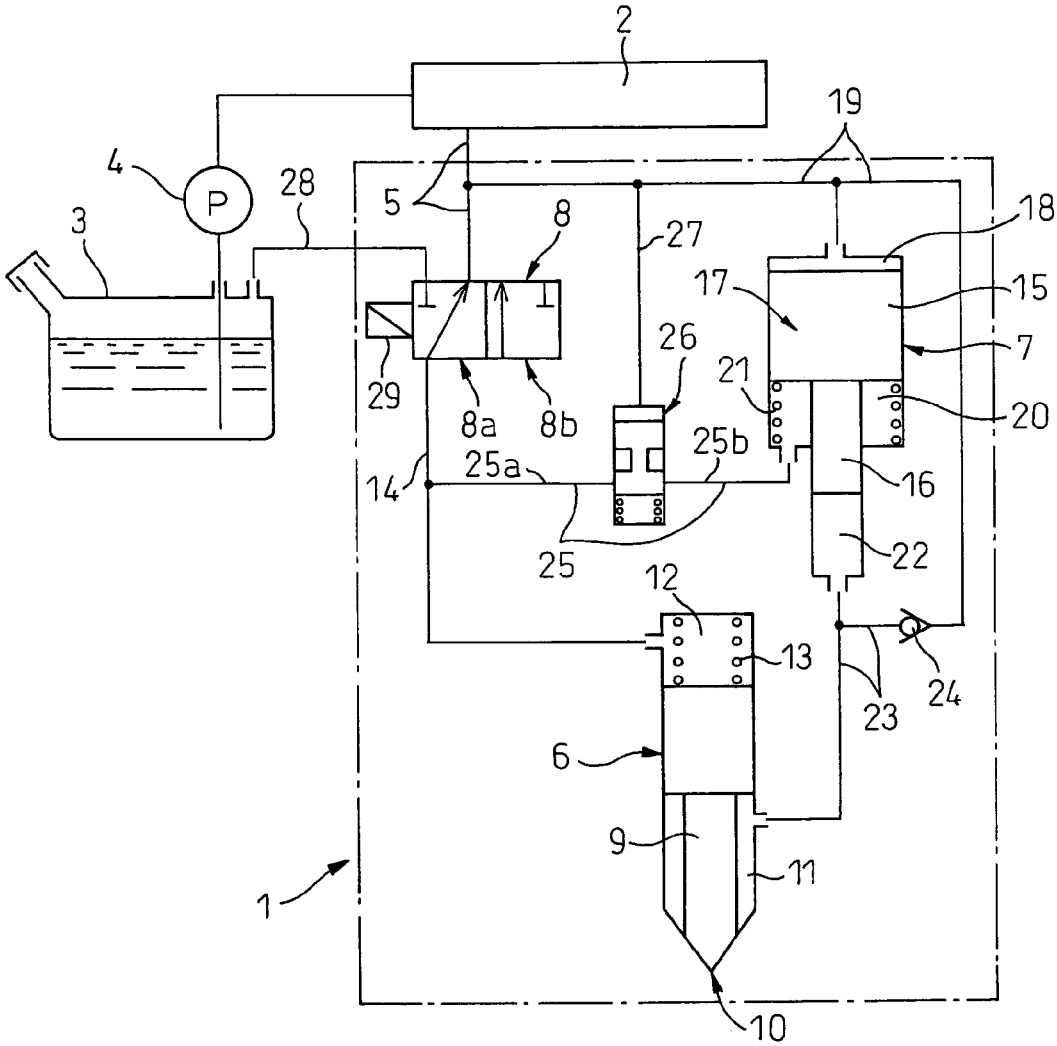
FIG. 1 is an overall view of a fuel injection system.

FIG. 1 schematically shows the fuel injection system as a whole. In FIG. 1, the part 1 surrounded by the broken lines shows the fuel injector attached to the engine. As shown in FIG. 1, the fuel injection system is provided with a common rail 2 for storing the high pressure fuel. This common rail 2 is supplied with fuel from a fuel tank 3 through a high pressure fuel pump 4. The fuel pressure in the common rail 2 is maintained at a target fuel pressure in accordance with the engine operating state by control of the amount of discharge of the high pressure fuel pump 4. The high pressure fuel in the common rail 2 maintained at the target fuel pressure is supplied through a high pressure fuel feed passage 5 to the fuel injector 1.

As shown in FIG. 1, the fuel injector 1 is provided with a nozzle part 6 for injecting fuel into the combustion chamber, a booster 7 for boosting the injection pressure, and a three-way valve 8 for switching the fuel passages. This three-way valve 8 is comprised of a two-position switching type three-way valve switching to one of two positions of one end position shown by 8*a* in FIG. 1 and another end position shown by 8*b* in FIG. 1. The nozzle part 6 is provided with a needle valve 9. The nozzle part 6 is formed at its front end with an injection port 10 (not shown) controlled to open and close by the front end of the needle valve 9. Around the needle valve 9 is formed a nozzle chamber 11 filled with the injected high pressure fuel. Above the top face of the needle valve 9 is formed a pressure control chamber 12 filled with fuel. The pressure control chamber 12 has a compression spring 13 for biasing the needle valve 9 downward, that is, in the valve-closing direction, inserted into it. This pressure control chamber 12 is connected through the fuel flow passage 14 to the three-way valve 8.

On the other hand, the booster 7 is provided with a booster piston 17 comprised of an integrally formed large diameter piston 15 and small diameter piston 16. Above the end face of the large diameter piston 15 on the side opposite to the small diameter piston 16 is formed a high pressure chamber 18 filled with high pressure fuel. This high pressure chamber 18 is connected through a high pressure fuel feed passage 19 to the high pressure fuel feed passage 5. Therefore, inside the high pressure chamber 18, the fuel pressure in the common rail 2 (hereinafter referred to as the "common rail pressure") is constantly acting. As opposed to this, above the end face of the large diameter piston 15 around the small diameter piston 16 is formed an intermediate chamber 20 filled with fuel. A compression spring 21 biasing the large diameter piston 15 toward the high pressure chamber 18 is inserted into this intermediate chamber 20. Further, above the end face of the small diameter piston 16 on the opposite side to the large diameter piston 15 is formed a booster chamber 22 filled with fuel. This booster chamber 22 and nozzle chamber 11 are connected through a high pressure fuel feed passage 23, a check valve 24 allowing flow only from the high pressure fuel feed passage 19 toward the high pressure fuel feed passage 23, and the high pressure fuel feed passage 19 to the high pressure fuel feed passage 5.

On the other hand, the fuel flow passage 25 connecting the three-way valve 8 and the intermediate chamber 20 is provided with an intermediate chamber control valve 26. This intermediate chamber control valve 26 controls the flow area of the fuel flow passage 25. Explaining this in another way, the intermediate chamber control valve 26 is on the one hand connected through the fuel flow passage 25*a* and fuel flow passage 14 to the three-way valve 8 and on the other hand is connected through the fuel flow passage 25*b* to the intermediate chamber 20. Further, the intermediate chamber control valve 26 is supplied with, for valve operation, the high pressure fuel in the common rail 2 supplied through the high pressure fuel feed passages 5, 19 and high pressure fuel feed passage 27.

On the other hand, the three-way valve 8 is connected to, in addition to the high pressure fuel feed passage 5 and fuel flow passage 14, for example, a fuel discharge passage 28 connected to the inside of the fuel tank 3. This three-way valve 8 is driven by an electromagnetic solenoid or piezoelectric element or other such actuator 29. This three-way valve 8 selectively connects the fuel flow passage 14 to one of the high pressure fuel feed passage 5 or fuel discharge passage 28.

Next, referring to FIG. 1, the operations of the needle valve 9 and the booster piston 17 in the case where the intermediate chamber control valve 26 fully opens the flow path of the fuel flow passage 25 will be explained.

FIG. 1 shows the case where the fuel passage switching action by the three-way valve 8 causes the fuel flow passage 14 to be connected to the high pressure fuel feed passage 5. In this case, both the inside of the pressure control chamber 12 and the inside of the intermediate chamber 20 become the common rail pressure. On the other hand, at this time, the inside of the nozzle chamber 11, the inside of the high pressure chamber 18, and the inside of the booster chamber 22 also become the common rail pressure. At this time, the fuel pressure inside the nozzle chamber 11 results in the force making the needle valve 9 descend due to the fuel pressure inside the pressure control chamber 12 and the spring force of the compression spring 13 becoming stronger than the force raising the needle valve 9. For this reason, the needle valve 9 is made to descend. As a result, the needle valve 9 closes, so the injection of fuel from the injection port 10 is stopped. On the other hand, regarding the booster 7, as explained above, the inside of the high pressure chamber 18, the inside of the intermediate chamber 20, and the inside of the booster chamber 22 all become the common rail pressure. Therefore, at this time, as shown in FIG. 1, the booster piston 17 is held in a state raised due to the spring force of the compression spring 21.

On the other hand, when the passage switching action of the three-way valve 8 causes the fuel flow passage 14 to be connected to the fuel discharge passage 28, the pressure control chamber 12 of the nozzle part 6 drops in fuel pressure, so the needle valve 9 rises and, as a result, the needle valve 9 opens and the fuel in the nozzle chamber 11 is injected from the nozzle port 10. On the other hand, at this time, the intermediate chamber 20 falls in fuel pressure, so the booster piston 17 is acted on by a large downward force and, as a result, the fuel pressure in the booster chamber 22 becomes higher than even the common rail pressure. Therefore, at this time, the fuel pressure in the nozzle chamber 11 connected through the high pressure fuel feed passage 23 to the inside of the booster chamber 22 also becomes higher than the common rail pressure. While the fuel is being injected, it is maintained at this high fuel pressure. Therefore, when the needle valve 9 opens, fuel is injected from the injection port 10 by an injection pressure higher than the common rail pressure.

Next, when the fuel passage switching action by the three-way valve 8 causes, as shown in FIG. 1, the fuel flow passage 14 to again be connected to the high pressure fuel feed passage 5, the inside of the pressure control chamber 12 of the nozzle part 6 becomes the common rail pressure and, as a result, the injection of fuel is stopped. Further, at this time, the inside of the intermediate chamber 20 of the booster 7 also becomes a common rail pressure. As a result, the booster piston 17 is again held in the state raised by the spring force of the compression spring 23 as shown by FIG. 1.

On the other hand, when the intermediate chamber control valve 26 shuts the fuel flow passage 25, whether the switching action of the three-way valve 8 causes the fuel flow passage 25*a* to be connected to the high pressure fuel feed passage 5 or to be connected to the fuel discharge passage 28, the intermediate chamber 20 does not fluctuate in fuel pressure, therefore the booster piston 17 does not operate. Therefore, at this time, the inside of the nozzle chamber 11 is constantly at the common rail pressure and therefore at the time of fuel injection, the injection pressure becomes the common rail pressure. In this way, the intermediate chamber control valve 26 controls the booster action of the booster piston 17.

Further, in a compression ignition type internal combustion engine, at the time of a light load, in particular at the time of an idling operation, the mechanical noise is low. Therefore, at this time, if a large combustion noise is generated, the passengers are given an unpleasant feeling. At the time of a light load operation or at the time of an idling operation, if making the injection pressure higher to raise the injection rate, the combustion pressure will rapidly rise, so combustion noise will be generated. Therefore, at this time, to reduce the combustion noise, the injection pressure, that is, the common rail pressure, has to be lowered. On the other hand, at the time of a high load operation, a large amount of fuel has to be injected within a certain determined time, so the injection pressure is made higher and the common rail pressure is made higher. In this way, the common rail pressure is low when the engine load or the output torque of the engine is small, while is made higher as the engine load or the output torque of the engine becomes higher.

Figure 2:
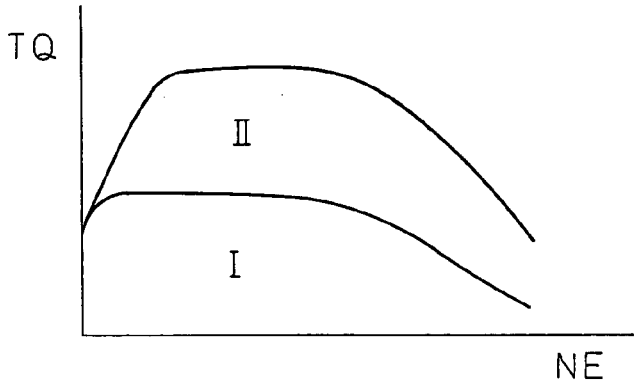
FIG. 2 is a view of low pressure side fuel region I and high pressure side fuel region II of a common rail pressure.

On the other hand, to further increase the engine output at the time of engine high load operation, it is necessary to inject a further greater amount of fuel within a certain determined time. Therefore, in the present invention, at the time of engine high load operation, to inject as large an amount of fuel within a certain determined time as possible, the booster piston 17 is operated to make the injection pressure increase. Note that the more the output torque of the engine increases, the more the common rail pressure is raised, so in the present invention, when the common rail pressure becomes higher, the booster piston 17 is made to act to increase the injection pressure. That is, in the present invention, as shown in FIG. 2, when the fuel pressure in the common rail 2 is in a high pressure side fuel region II higher than a predetermined fuel pressure, the booster piston 17 is operated, while when the fuel pressure in the common rail 2 is in a low pressure side fuel region I lower than the predetermined fuel pressure, the booster action by the booster piston 17 is weakened compared with when the fuel pressure in the common rail 2 is in the high pressure side fuel region II or the operation of the booster piston 17 is stopped. Note that, in FIG. 2, the ordinate TQ shows the output torque of the engine, while the abscissa NE shows the engine speed. Further, to operate the booster piston 17, the high pressure fuel in the intermediate chamber 20 has to be discharged into the fuel discharge passage 28. Discharging the high pressure fuel in this way means energy loss. Therefore, the amount of discharge of the high pressure fuel is preferably reduced as much as possible. In regard to this point, in the present invention, in the low pressure side fuel region I of FIG. 2, the operation of the booster piston 17 is stopped to reduce the amount of discharge of the high pressure fuel.

Next, referring to FIGS. 3(A), (B), the first embodiment of the intermediate chamber control valve 26 designed to operate the booster piston 17 when the fuel pressure in the common rail 2 is in the high pressure side fuel region II shown in FIG. 2 and to stop the operation of the booster piston 17 when the fuel pressure in the common rail 2 is in the low pressure side fuel region I shown in FIG. 2 will be explained.

Referring to FIG. 3(A), the intermediate chamber control valve 26 is provided with a cylindrical valve chamber 30, a valve element 31 moving back and forth in the valve chamber 30, and a high pressure chamber 32 formed on one end face of the valve element 31 in the axial direction and connected through the high pressure fuel feed passage 27 to the inside of the common rail 2. The outer circumferential face at the center of the valve element 31 in the axial direction is formed with a ring-shaped groove 33. Due to this, the valve element 31 is comprised of a first valve element 31*a* and second valve element 31*b* separated from each other and connected with each other in that axial direction and sliding on the inner circumferential face of the valve chamber 30. In this embodiment, the first valve element 31*a* and the second valve element 31*b* have the same outside diameter.

As shown in FIG. 3(A), the high pressure chamber 32 is formed above the outer end face of the first valve element 31*a*, while the end chamber 34 is formed above the outer end face of the second valve element 31*b*. Further, an intervalve chamber 35 is formed in the groove 33 between the first valve element 31*a* and the second valve element 31*b*. On the other hand, a spring member 36 for biasing the first valve element 31*a* and second valve element 32*b* toward the high pressure chamber 32 is inserted in the end chamber 34. This end chamber 34 is connected to the fuel discharge passage 28. The fuel flow passages 25*a* and 25*b* are arranged to be aligned. The valve chamber 30 is formed on its inner circumferential face with a three-way valve side fuel flow opening 37 connected through the fuel flow passage 25*a* to the three-way valve 8 and with an intermediate chamber side fuel flow opening 38 connected through the fuel flow passage 25*b* to the intermediate chamber 20.

When the fuel pressure in the common rail 2 is in the low pressure side fuel region I shown in FIG. 2, the valve element 31, as shown in FIG. 3(A), rises due to the spring force of the spring member 36. At this time, the three-way valve side fuel flow opening 37 and the intermediate chamber side fuel flow opening 38 are closed by the outer circumferential face of the second valve element 31*b*. That is, the fuel flow passage 25 is shut by the intermediate chamber control valve 26. Therefore, at this time, the operation of the booster piston 17 is stopped, and the injection pressure becomes the common rail pressure.

As opposed to this, when the fuel pressure in the common rail 2 is in the high pressure side fuel region II shown in FIG. 2, the valve element 31, as shown in FIG. 3(B), is pushed down by the common rail pressure inside the high pressure chamber 32 against the spring force of the spring member 36, and both the three-way valve side fuel flow opening 37 and intermediate chamber side fuel flow opening 38 open into the intervalve chamber 35. That is, the intermediate chamber control valve 26 fully opens the flow path of the fuel flow passage 25. Therefore, when at this time the flow path switching action by the three-way valve 8 causes the fuel flow passage 14 to be connected to the high pressure fuel feed passage 5, the high pressure fuel in the common rail 2 is fed into the intermediate chamber 20, while when it causes the fuel flow passage 14 to be connected to the fuel discharge passage 28, the high pressure fuel in the intermediate chamber 20 is discharged, so the booster piston 17 performs a booster action.

Figure 3:
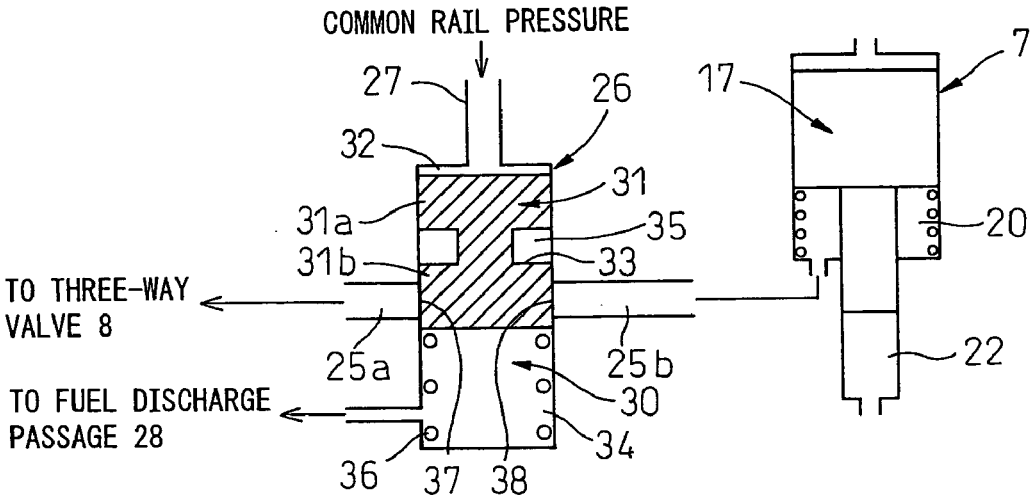
FIG. 3 is a view of a first embodiment of the intermediate chamber control valve.
Figure 3:
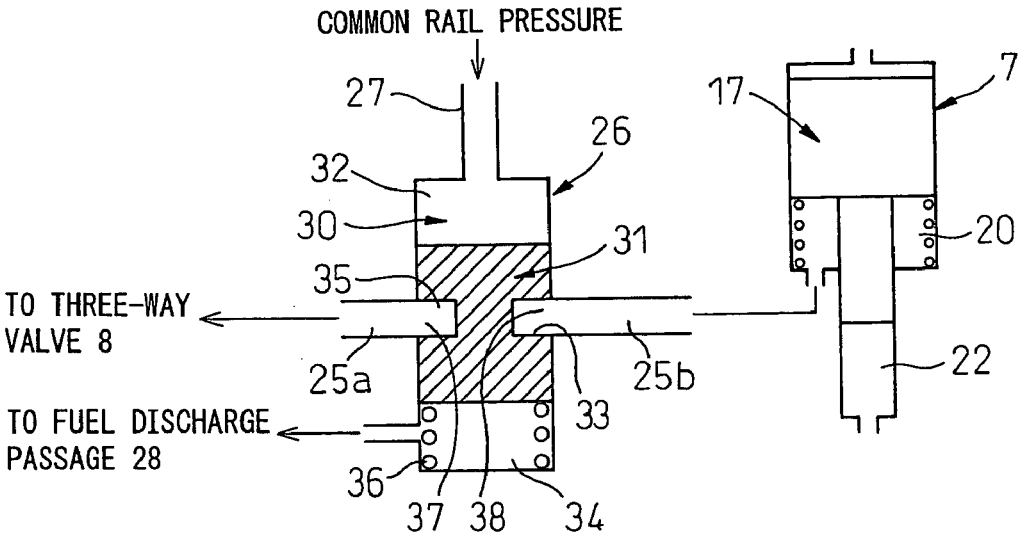

In the first embodiment shown in FIG. 3, whether the valve element 31 is in the state shown in FIG. 3(A) or is in the state shown in FIG. 3(B), if the fuel flow passage 25*a* is supplied with the high pressure fuel in the common rail 2, this high pressure fuel passes between the outer circumferential face of the second valve element 31*b* and the inside wall of the valve chamber 30 to leak to the inside of the end chamber 34 and the fuel leaking inside the end chamber 34 is discharged to the fuel discharge passage 28. However, if structuring the system so that the high pressure fuel leaks in this way, the high pressure fuel pump 4 increases in drive energy, so this is not preferable. The following embodiments show structures preventing leakage of this high pressure fuel. Note that, in the following embodiments, structures similar to the structure shown in FIG. 3 are assigned the same reference numerals.

Figure 4:
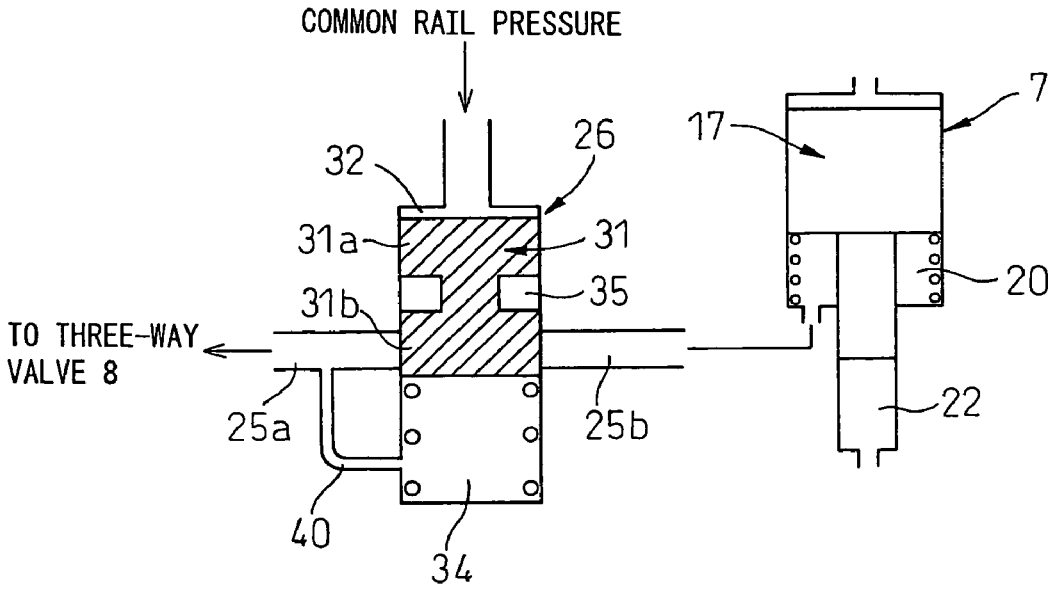
FIG. 4 is a view of a second embodiment of an intermediate chamber control valve.
Figure 4:
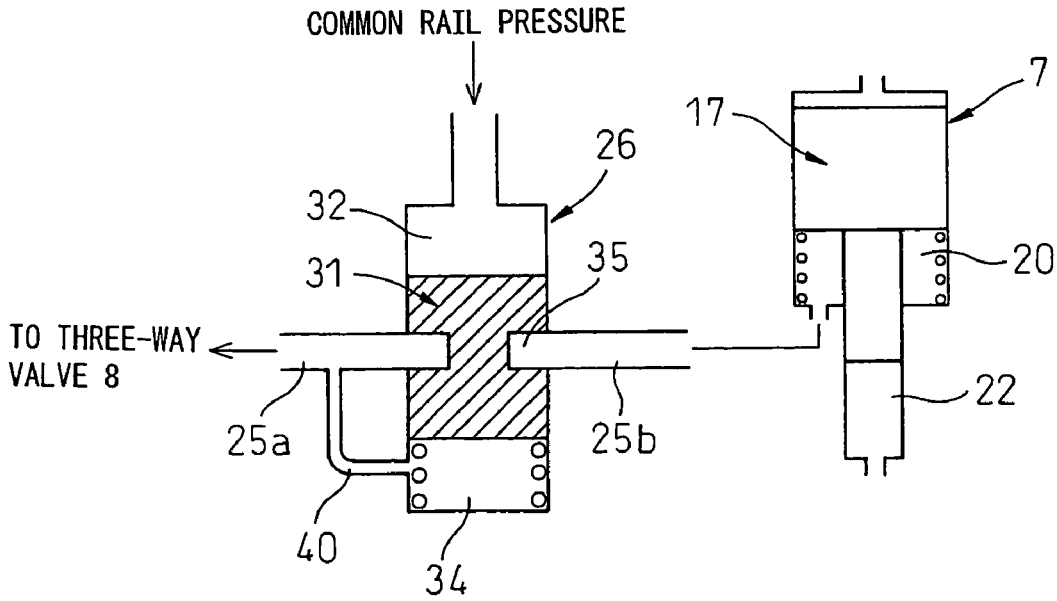

FIGS. 4(A), (B) show a second embodiment. This second embodiment differs from the first embodiment in preventing leakage of high pressure fuel in the intermediate chamber control valve 26 by having the end chamber 34 connected to the fuel flow passage 25*a* through the fuel passage 40 with a flow area smaller than the fuel flow passages 25*a*, 25*b*. In this second embodiment as well, when the fuel pressure in the common rail 2 is in the high pressure side fuel region II shown in FIG. 2, the booster piston 17 is operated, while when the fuel pressure in the common rail 2 is the low pressure side fuel region I shown in FIG. 2, the operation of the booster piston 17 is stopped, but by providing the fuel passage 40, the movement of the valve element 31 when performing the booster action is somewhat different from that of the first embodiment.

That is, when the fuel pressure in the common rail 2 is in the low pressure side fuel region I shown in FIG. 2, the valve element 31 rises as shown in FIG. 4(A). At this time, the second valve element 31*b* shuts the fuel flow passages 25*a*, 25*b*. Note that when the flow path switching action by the three-way valve 8 causes the fuel pressure in the fuel flow passage 25*a* to fluctuate, the fuel pressure in the end chamber 34 also fluctuates, but the fuel pressure in the high pressure chamber 32 is not that high, so the valve element 31 is held at the raised position as shown in FIG. 4(A).

On the other hand, when the fuel pressure in the common rail 2 is in the high pressure side fuel region II shown in FIG. 2, the fuel pressure in the high pressure chamber 32 becomes higher. At this time, when the flow path switching action by the three-way valve 8 causes the fuel flow passage 25*a* to be connected to the high pressure fuel flow passage 5, the fuel pressure in the end chamber 34 becomes higher, so, as shown in FIG. 4(A), the valve element 31 rises. However, in actuality, due to the fuel passage 40 having a small flow area and the inertia of the valve element 31, even if the fuel flow passage 25*a* is connected to the high pressure fuel flow passage 5, the valve element 31 does not immediately rise and, as shown in FIG. 4(B), the intermediate chamber control valve 26 is maintained in the state with the flow path of the fuel flow passage 25 fully opened. Therefore, during this time, the inside of the intermediate chamber 20 is supplied with high pressure fuel.

Next, when the flow path switching action by the three-way valve 8 causes the fuel flow passage 25*a* to be connected to the fuel discharge passage 28, the fuel pressure in the end chamber 34 falls, so, as shown in FIG. 4(B), the valve element 31 descends and the intermediate chamber control valve 26 fully opens the flow path of the fuel flow passage 25. As a result, the intermediate chamber 20 falls in fuel pressure and the booster piston 17 performs the booster action.

Figure 5:
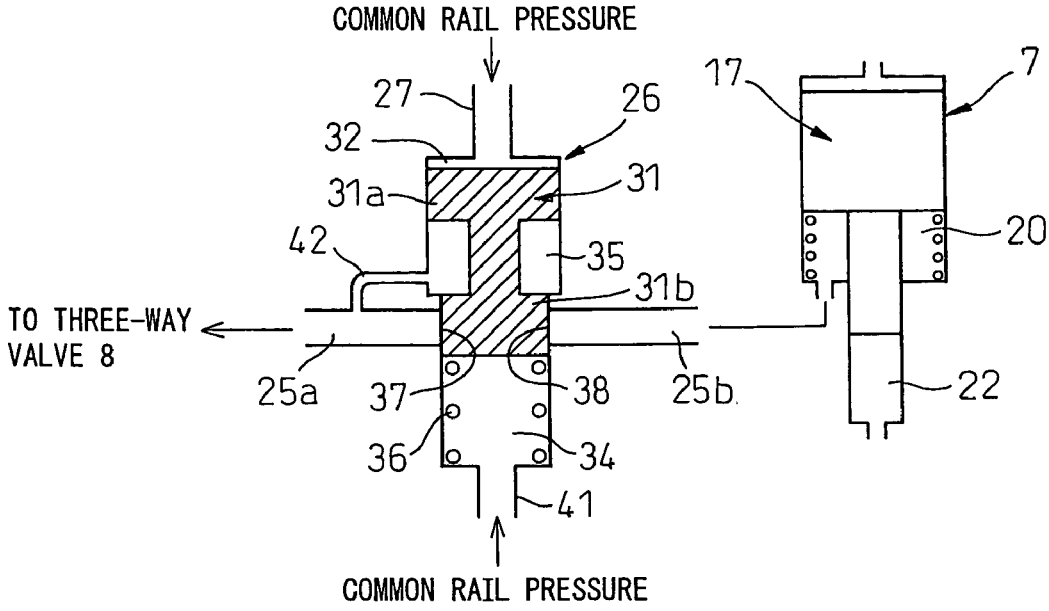
FIG. 5 is a view of a third embodiment of the intermediate chamber control valve.
Figure 5:
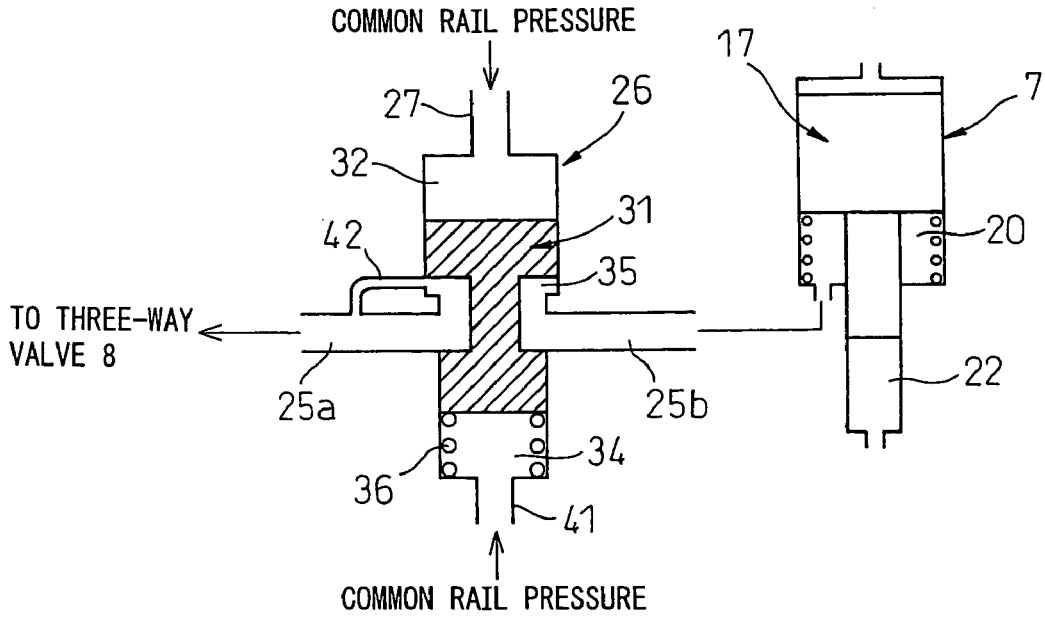

FIGS. 5(A), (B) show a third embodiment. In the first embodiment and second embodiment, the spring force of the spring member 36 is used to impart an upward force to the valve element 31, so a spring member 36 comprised of a large sized, powerful spring member is necessary. In the third embodiment, the outside diameter of the second valve element 31*b* is made smaller than the outside diameter of the first valve element 31*a* and the end chamber 34 is connected through the high pressure fuel feed passage 41 to the common rail 2 to make the fuel pressure in the end chamber 34 the common rail pressure and a downward fuel pressure is made to act against the valve element 31 by exactly the difference in cross-sectional area between the first valve element 31*a* and the second valve element 31*b*, so a spring member 36 comprised of a small sized, weak spring member may be used. Note that, in this third embodiment, the intervalve chamber 35 is also constantly connected to the fuel flow passage 25*a* through the fuel passage 42 with a flow area smaller than the fuel flow passage 25*a*.

In this third embodiment as well, when the fuel pressure in the common rail 2 is in the low pressure side fuel region I shown in FIG. 2, the valve element 31 rises as shown in FIG. 5(A). At this time, the second valve element 31*b* shuts the fuel flow passages 25*a*, 25*b*. Note that if the flow path switching action by the three-way valve 8 results in the fuel pressure in the fuel flow passage 25*a* fluctuating, the fuel pressure in the intervalve chamber 35 will also fluctuate, but the fuel pressure in the high pressure chamber 32 will not become that high, so the valve element 31 will be held at the risen position as shown in FIG. 5(A).

On the other hand, when the fuel pressure in the common rail 2 is in the high pressure side fuel region II shown in FIG. 2, the high pressure chamber 32 and the end chamber 34 become higher in fuel pressure. At this time, when the flow path switching action by the three-way valve 8 causes the fuel flow passage 25*a* to be connected to the high pressure fuel flow passage 5, the fuel pressure in the intervalve chamber 35 becomes the common rail pressure, so, as shown in FIG. 5(A), the valve element 31 rises by the spring force of the spring member 36. However, in actuality, even if the inertia of the valve element 31 causes the fuel flow passage 25*a* to be connected to the high pressure fuel flow passage 5, the valve element 31 does not immediately rise and, as shown in FIG. 5(B), the intermediate chamber control valve 26 is maintained in the state with the flow path of the fuel flow passage 25 fully opened. Therefore, during this interval, the intermediate chamber 20 is supplied with high pressure fuel.

Next, when the flow path switching action by the three-way valve 8 causes the fuel flow passage 25*a* to be connected to the fuel discharge passage 28, the fuel pressure in the intervalve chamber 35 drops, so as shown in FIG. 5(B), the valve element 31 descends and the intermediate chamber control valve 26 fully opens the flow path of the fuel flow passage 25. As a result, the intermediate chamber 20 drops in fuel pressure and the booster piston 17 performs the booster action.

Figure 6:
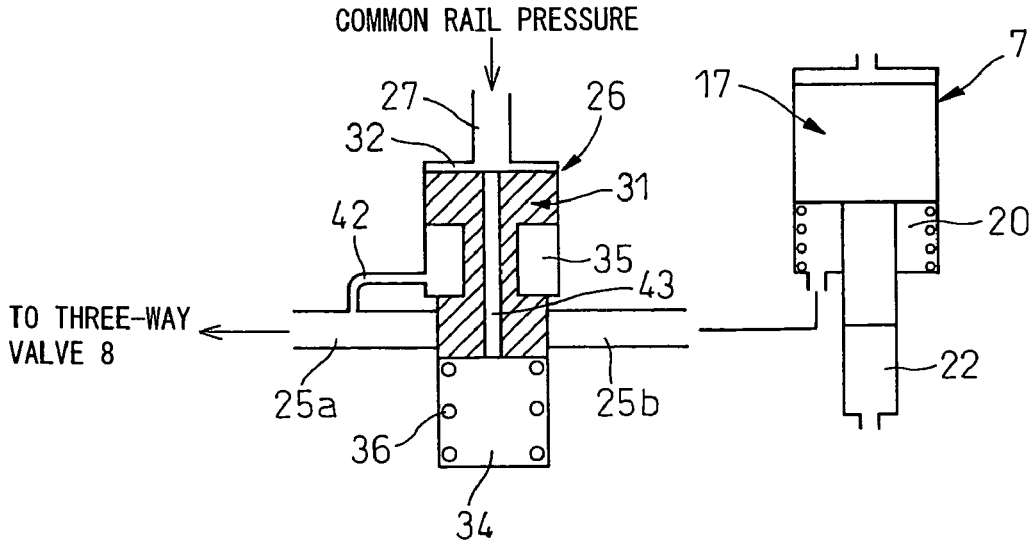
FIG. 6 is a view of a fourth embodiment of an intermediate chamber control valve.

FIG. 6 shows the fourth embodiment. In this fourth embodiment, the valve element 31 is formed on its center axial line with a fuel passage 43. High pressure fuel in the high pressure chamber 32 is fed through the fuel passage 43 to the inside of the end chamber 34. In this fourth embodiment, to feed high pressure fuel into the end chamber 34, it is advantageous that it is not necessary to form the high pressure fuel feed passage 41 in the fuel injector 1, as shown in FIGS. 5(A), (B). Further, the difference between the passage length between the high pressure chamber 32 and common rail 2 and the passage length between the end chamber 34 and the common rail 2 can be made small, so when the pressure pulsation occurring in the common rail 2 is propagated in the high pressure chamber 32 and in the end chamber 34, no phase difference arises between the pressure pulsations in the high pressure chamber 32 and in the end chamber 34, therefore the valve element 31 can be prevented from vibrating.

Figure 7:
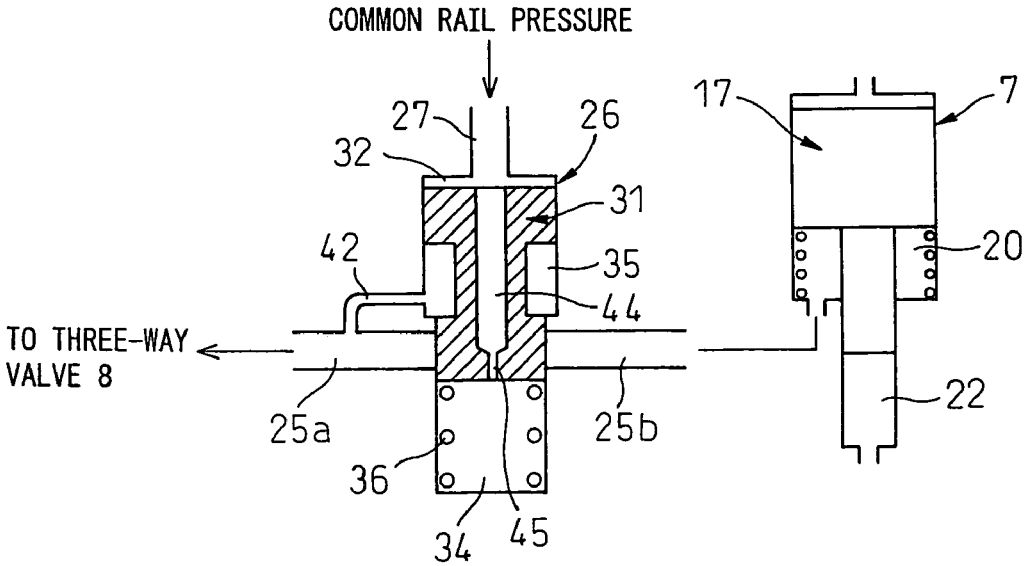
FIG. 7 is a view of a fifth embodiment of an intermediate chamber control valve.

FIG. 7 shows a fifth embodiment. In this fifth embodiment as well, the valve element 31 is formed with a fuel passage 44 connecting the high pressure chamber 32 and the end chamber 34, and a restricted opening 45 is formed in this fuel passage 44. The speed of movement of the valve element 31 is determined by the speed of movement of the fuel from the high pressure chamber 32 to the end chamber 34 or the speed of movement of the fuel from the end chamber 34 to the high pressure chamber 32. To eliminate the variation in the speeds of movement among the fuel injectors 1 of the different cylinders, it is necessary to match the speeds of movement of the fuel from the high pressure chamber 32 to the end chamber 34 and from the end chamber 34 to the high pressure chamber 32. In this fifth embodiment, the restricted opening 45 is formed to a high precision to enable the speeds of movement of the valve elements 31 to be matched.

Figure 8:
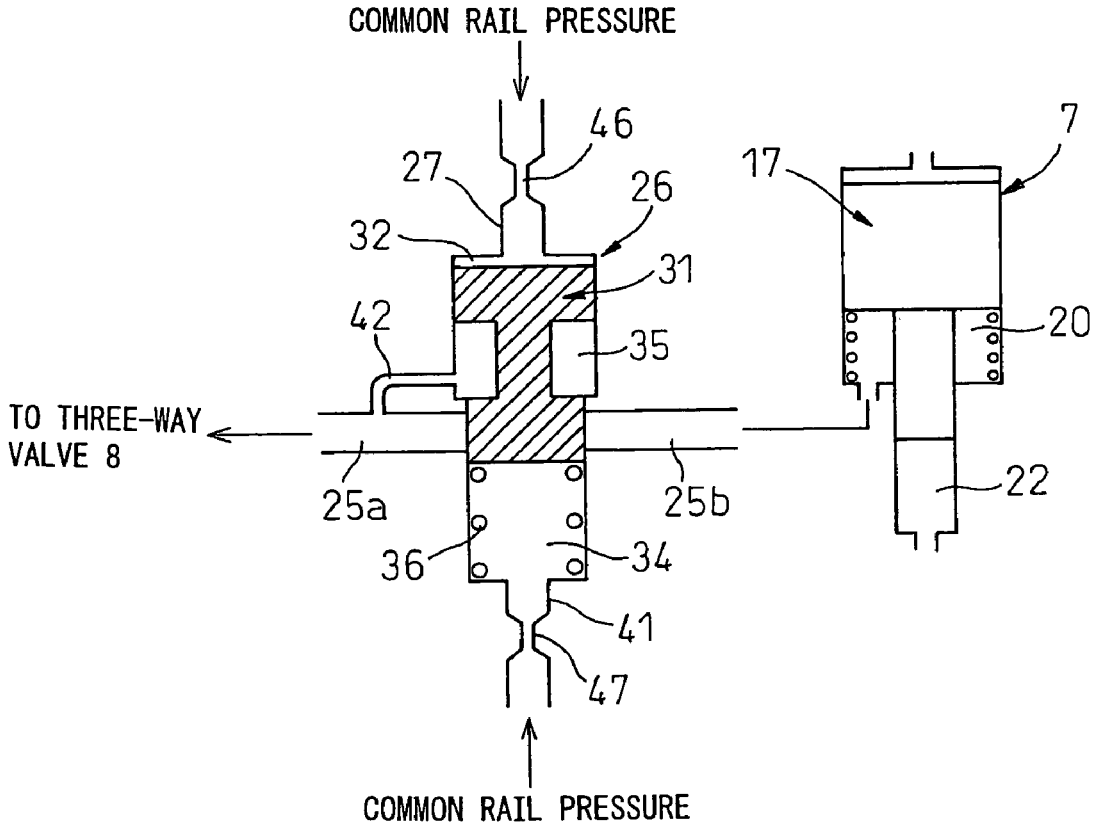
FIG. 8 is a view of a modification of the third embodiment of the intermediate chamber control valve.

Further, to eliminate the variation in the speeds of movement among the fuel injectors 1 of the different cylinders, in the embodiment shown in FIGS. 5(A), (B), it is also possible as shown in FIG. 8 to provide restricted openings 46, 47 in the high pressure fuel feed passages 27, 41 connected to the high pressure chamber 32 and end chamber 34.

Figure 9:
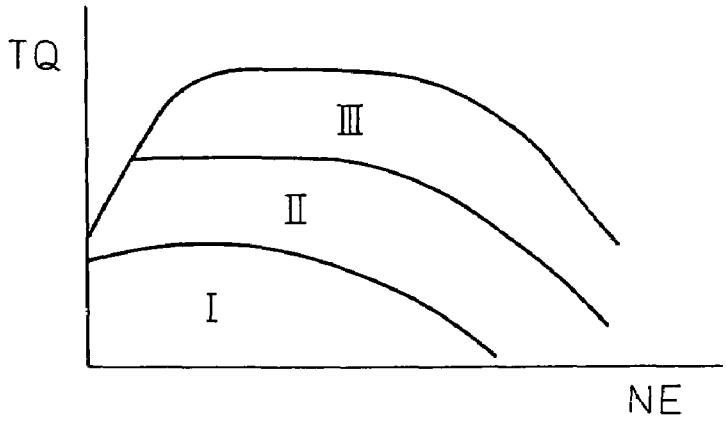
FIG. 9 is a view of an intermediate chamber control valve etc.
Figure 9:
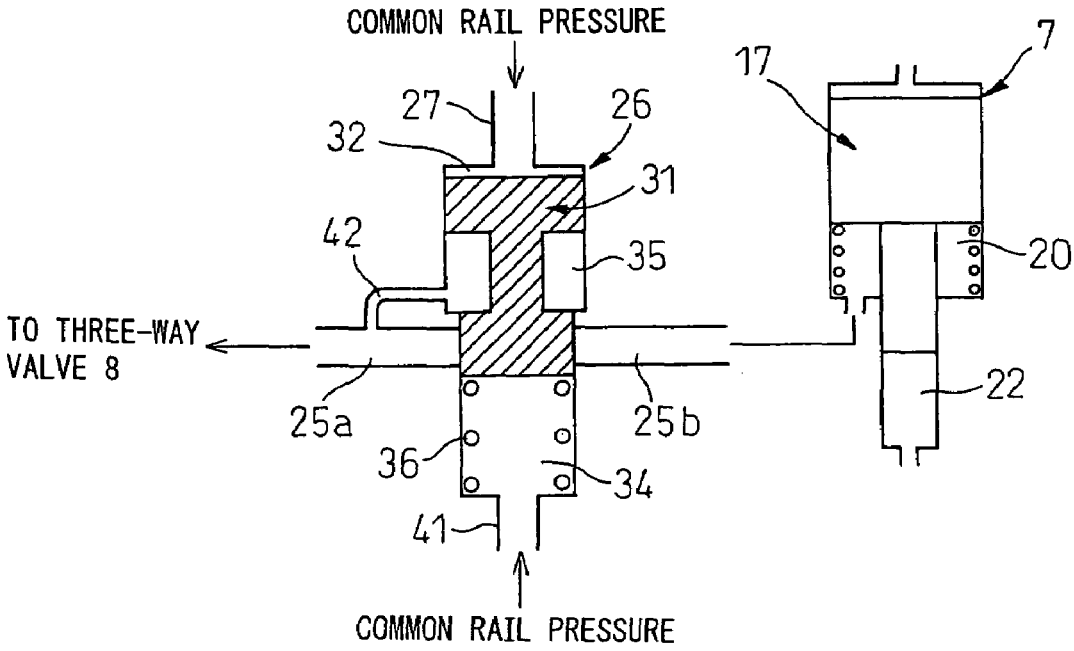

On the other hand, in the embodiment shown in FIG. 5(A), (B), depending on the method of setting the spring force of the spring member 36, the booster action by the booster piston 17 can be strengthened as the common rail pressure increases. In this case, the intermediate chamber control valve 26 operates as shown in FIG. 9(A), (B) and FIGS. 10(A), (B). That is, in this case, when the fuel pressure in the common rail 2 is in the high pressure side fuel region III shown in FIG. 9(A), the booster piston 17 is made to strongly operate, when the fuel pressure in the common rail 2 is in the intermediate pressure side fuel region II shown in FIG. 9(A), the booster action of the booster piston 17 is reduced, while when the fuel pressure in the common rail 2 is in the low pressure side fuel region I shown in FIG. 9(A), the operation of the booster piston 17 is stopped. Note that in FIG. 9(A) as well, TQ indicates the output torque of the engine, while NE indicates the engine speed.

That is, when the fuel pressure in the common rail 2 is in the low pressure side fuel region I shown in FIG. 9(A), in the same way as when the fuel pressure in the common rail 2 is in the low pressure side fuel region I shown in FIG. 2 in the embodiment shown in FIG. 5(A), (B), the valve element 31 is made to rise at all times and the operation of the booster piston 17 is made to stop, as shown in FIG. 9(B).

Figure 10:
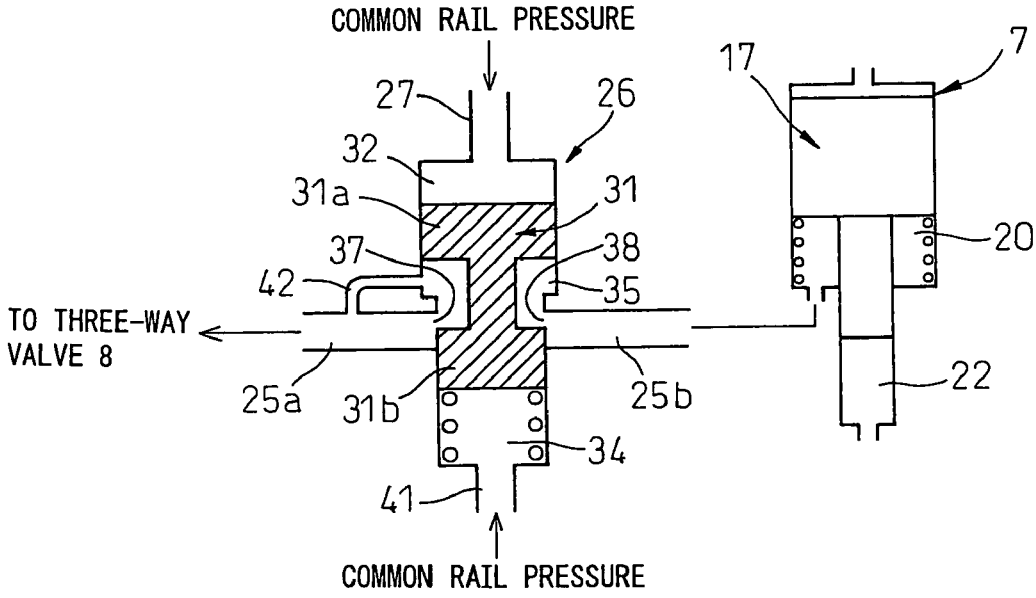
FIG. 10 is a view of an intermediate chamber control valve.
Figure 10:
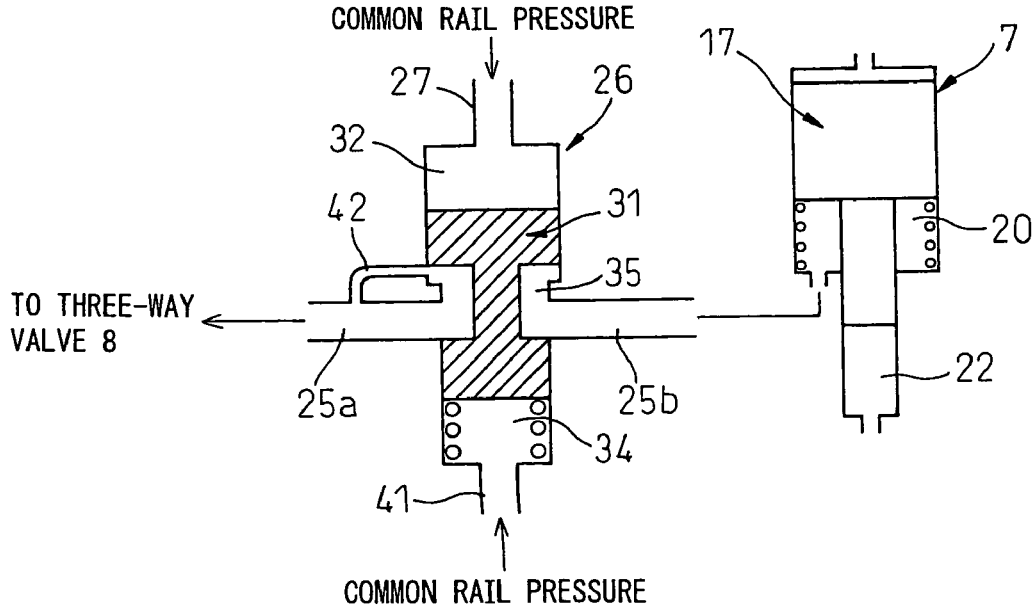

On the other hand, when the fuel pressure in the common rail 2 is in the high pressure side fuel region III shown in FIG. 9(A), in the same way as when the fuel pressure in the common rail 2 is in the high pressure side fuel region II shown in FIG. 2 in the embodiment shown in FIG. 5(A), (B), when the fuel flow passage 25*a* is connected to the fuel discharge passage 28, as shown in FIG. 10(B), the valve element 31 descends to the lowermost position. As a result, the fuel flow passages 25*a*, 25*b* are fully opened in flow paths and the booster piston 17 performs a powerful booster action.

On the other hand, when the fuel pressure in the common rail 2 is in the intermediate pressure side fuel region II shown in FIG. 9(A), when the fuel flow passage 25*a* is connected to the fuel discharge passage 28, the valve element 31, i.e, as shown in FIG. 10(A), the second valve element 31*b* partially opens the three-way valve side fuel flow opening 37 and intermediate chamber side fuel flow opening 38. That is, as the fuel pressure in the common rail 2 rises, the fuel flow openings 37, 38 opening into the intervalve chamber 35 gradually increase in opening areas. If the opening areas of the fuel flow openings 37, 38 opening into the intervalve chamber 35 are increased, the booster piston 17 performs the booster action is strengthened, therefore, in the embodiment shown in FIGS. 9(A), (B) and FIGS. 10(A), (B), as the fuel pressure in the common rail 2 becomes higher, the booster piston 17 performs the booster action is strengthened.

Further, in the embodiment shown from FIG. 5(A), (B) to FIG. 10(A), (B), when the fuel flow passage 25*a* is connected to the high pressure fuel feed passage 5, before high pressure fuel is sufficiently fed to the intermediate chamber 20, the intermediate chamber control valve 26 ends up shutting the fuel flow passage 25. As a result, there is the hazard that a good booster action can no longer be performed. Further, if the common rail pressure gradually drops, the intermediate chamber control valve 26 ends up shutting the fuel flow passage 25 in the state where the high pressure fuel in the intermediate chamber 20 is drained. As a result, when the common rail pressure requiring boosting is reached, there is the hazard that the booster action will no longer be performed until the intermediate chamber 20 is filled with high pressure fuel.

Figure 11:
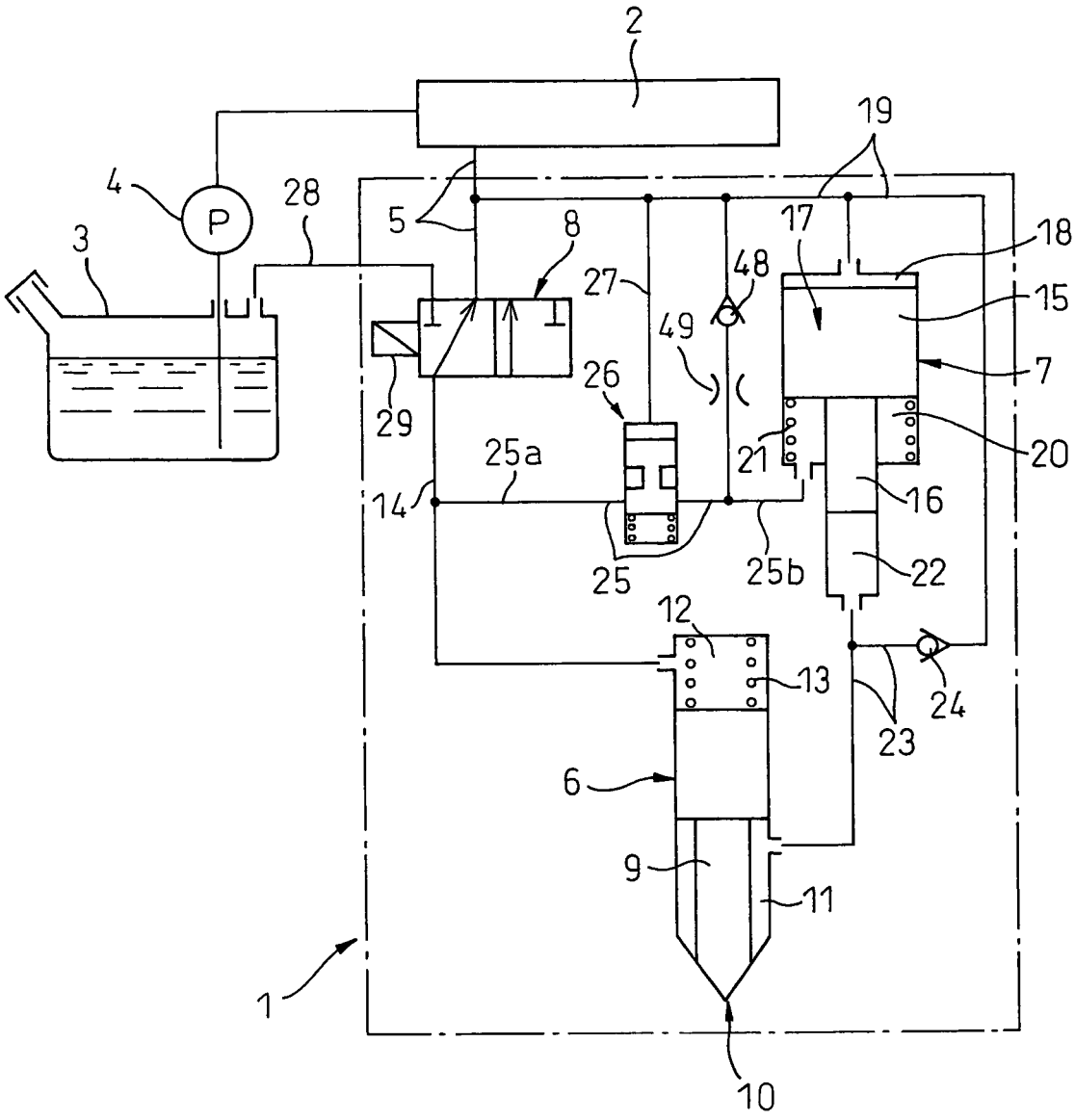
FIG. 11 is an overall view of a fuel injection system.

When there is this hazard, as shown in FIG. 11, the intermediate chamber 20 may be connected through a check valve 48 enabling communication only from the inside of the common rail 2 toward the inside of the intermediate chamber 20 and a restricted opening 49 to the inside of the common rail 2. By doing this, even if the intermediate chamber control valve 26 shuts the fuel flow passage 25, the intermediate chamber 20 is filled by the high pressure fuel, so when reaching the common rail pressure to be boosted to, a booster action can be performed reliably.

When connecting the intermediate chamber 20 through the check valve 48 to the common rail 2 in this way, it is also possible to make the intermediate chamber control valve 26 act to just discharge the high pressure fuel in the intermediate chamber 20.

Figure 12:
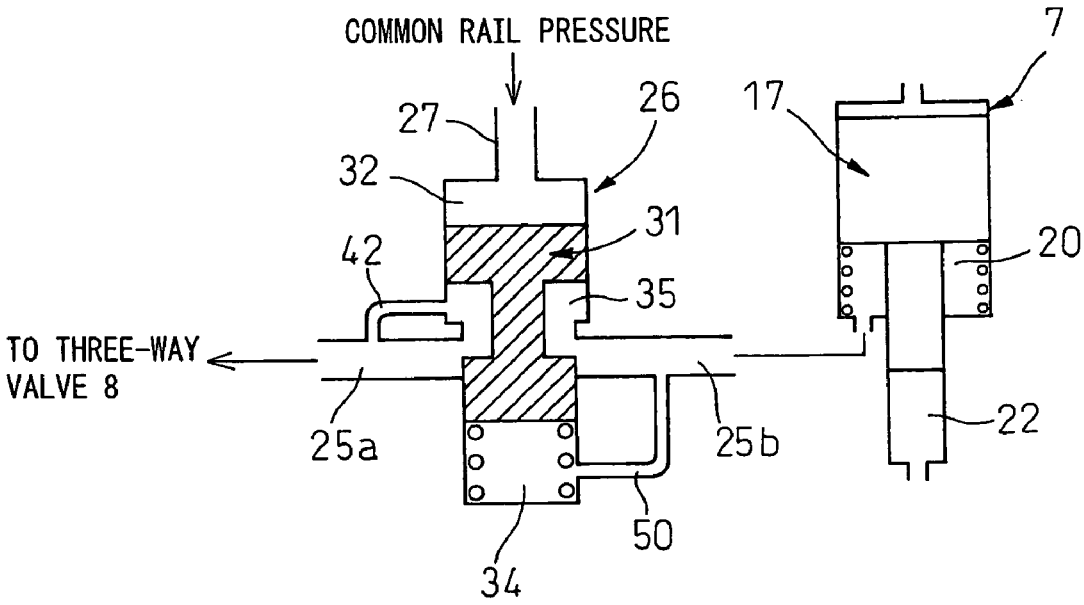
FIG. 12 is a view of another embodiment of an intermediate chamber control valve.

Further, to fill the intermediate chamber 20 with high pressure fuel, as shown in FIG. 12, it is also possible to connect the end chamber 34 and the fuel flow passage 25*b* or intermediate chamber 20 through a fuel passage 50 with a flow area smaller than the fuel flow passage 25*b*. By doing this, the intermediate chamber 20 is filled with high pressure fuel, then the fuel pressure in the end chamber 34 rises, so until the intermediate chamber 20 is filled with high pressure fuel, the intermediate chamber control valve 26 no longer shuts the fuel flow passages 25*a*, 25*b* and therefore the intermediate chamber 20 is reliably filled with high pressure fuel.

Figure 13:
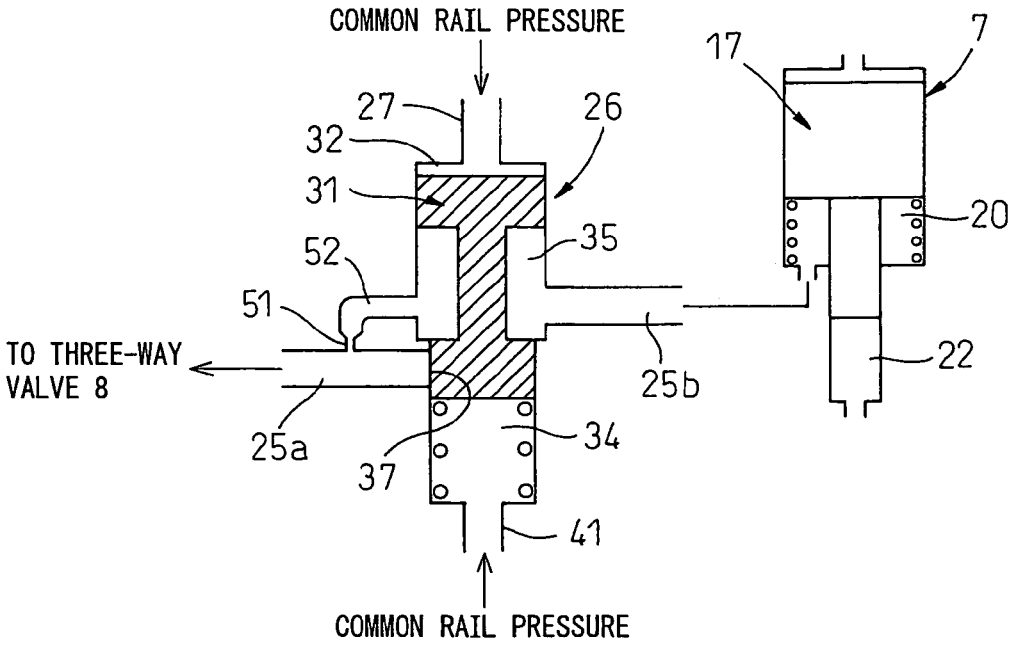
FIG. 13 is a view of still another embodiment of an intermediate chamber control valve.
Figure 13:
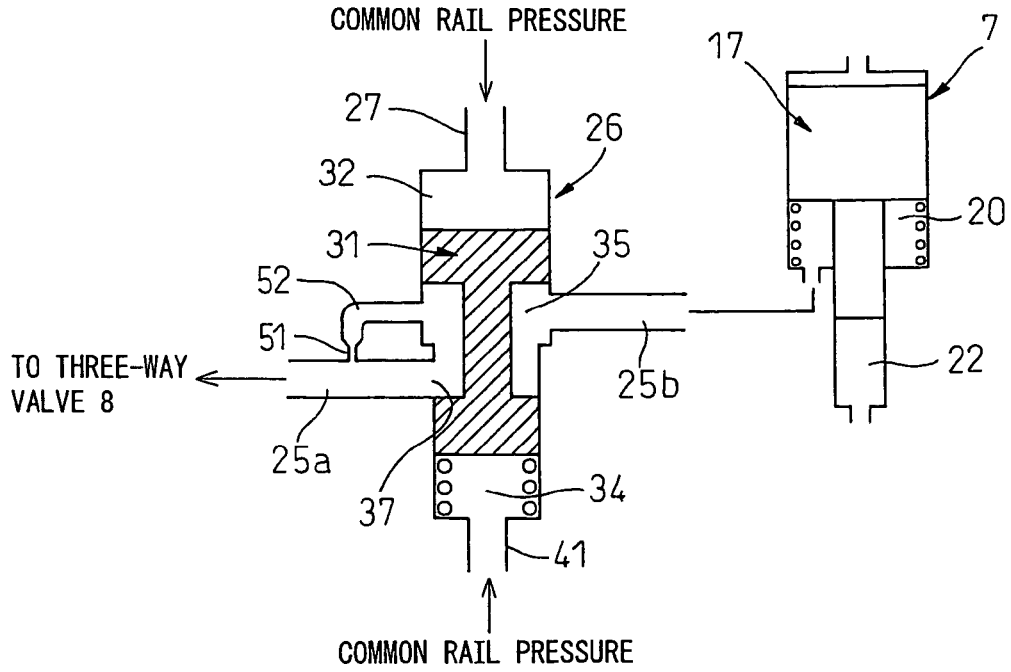

Next, referring to FIGS. 13(A), (B), an embodiment configured so that the booster piston 17 is operated when the fuel pressure in the common rail 2 is in the high pressure side fuel region II shown in FIG. 2 and the booster action of the booster piston 17 is weakened when the fuel pressure in the common rail 2 is in the low pressure side fuel region I shown in FIG. 2 compared with when the fuel pressure in the common rail 2 is in the high pressure side fuel region II will be shown.

In this embodiment, the fuel flow passage 25*b* connected to the intermediate chamber 20 is constantly connected with the inside of the intervalve chamber 35, while the fuel flow passage 25*a* connected to the three-way valve 8 is constantly connected through a restricted opening 51 and a bypass passage 52 to the inside of the intervalve chamber 35. That is, in this embodiment, when the fuel pressure in the common rail 2 is in the low pressure side fuel region I shown in FIG. 2, as shown in FIG. 13(A), the valve element 31 rises and, at this time, the three-way valve side fuel flow opening 37 is closed by the second valve element 31*b*. Therefore, at this time, the intermediate chamber 20 is constantly connected through the bypass passage 52 and restricted opening 51 to the fuel flow passage 25*a* and, as a result, the booster piston 17 performs a weak booster action.

On the other hand, when the fuel pressure in the common rail 2 is in the high pressure side fuel region II shown in FIG. 2, the three-way valve side fuel flow opening 37 completely opens into the intervalve chamber 35 when the fuel flow passage 25*a* is connected to the fuel discharge passage 28, as shown in FIG. 13(B). Therefore, at this time, a powerful booster action is performed.

Figure 14:
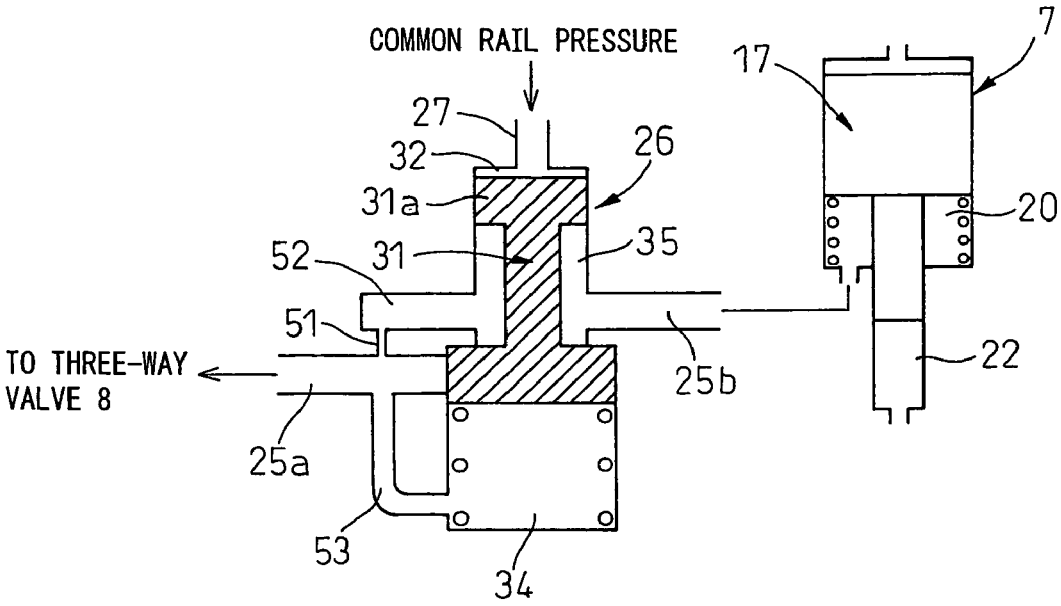
FIG. 14 is a modification of the embodiment shown in FIG. 13 of an intermediate chamber control valve.
Figure 14:
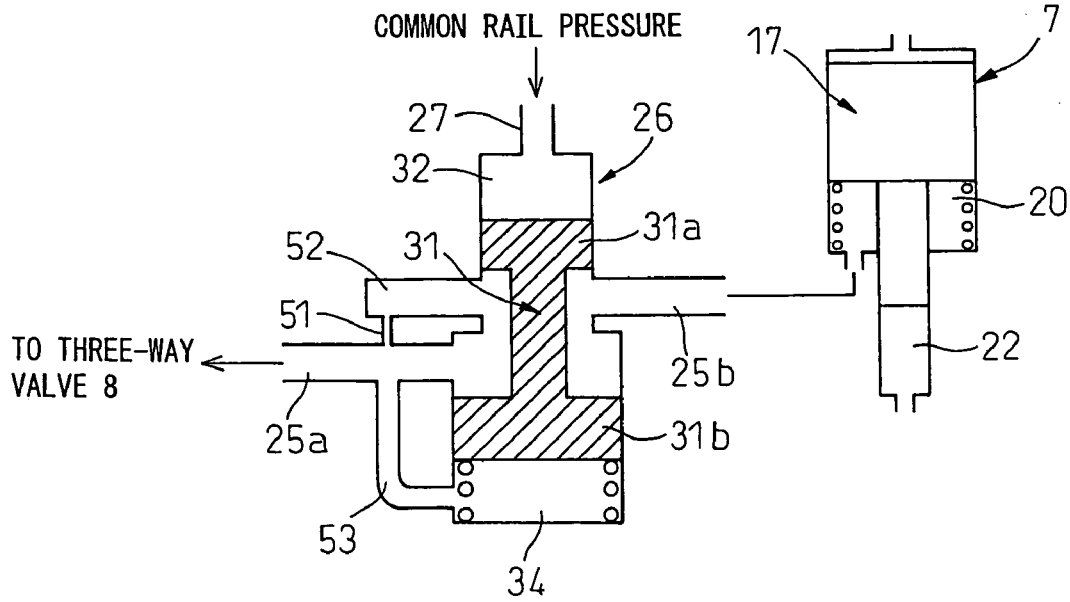

FIGS. 14(A), (B) show a modification of the embodiment shown in FIGS. 13(A), (B). In this modification, the outside diameter of the second valve element 31*b* is formed larger than the outside diameter of the first valve element 31*a* and the end chamber 34 is connected to the fuel flow passage 25*a* through a fuel passage 53 having a flow area of the same extent as the fuel flow passage 25*a*. In this embodiment as well, when the fuel pressure in the common rail 2 is in the low pressure side fuel region I shown in FIG. 2, the valve element 31 rises as shown in FIG. 14(A), therefore, at this time, a weak booster action is performed.

On the other hand, when the fuel pressure in the common rail 2 is in the high pressure side fuel region II shown in FIG. 2, the high pressure chamber 32 rises in fuel pressure. At this time, if the flow path switching action by the three-way valve 8 causes the fuel flow passage 25*a* to be connected to the high pressure fuel flow passage 5, the end chamber 34 immediately becomes higher in fuel pressure, so, as shown in FIG. 14(A), the valve element 31 rises. At this time, the high pressure fuel is fed through the restricted opening 51 and bypass passage 52 to the inside of the intermediate chamber 20. Next, when the flow path switching action by the three-way valve 8 causes the fuel flow passage 25*a* to be connected to the fuel discharge passage 28, the end chamber 34 immediately falls in fuel pressure, so, as shown in FIG. 14(B), the valve element 31 descends. As a result, the three-way valve side fuel flow opening 37 fully opens to the inside of the intervalve chamber 35 and therefore a powerful booster action is performed.

The invention claimed is:

1. A fuel injection system fuel injection system selectively connecting a pressure control chamber formed on an inside end of a needle valve and an intermediate chamber of a booster piston for increasing the injection pressure through a two-position switching type three-way valve to the inside of a common rail or a fuel discharge passage, discharging high pressure fuel inside the common rail supplied into the pressure control chamber into the fuel discharge passage so as to open the needle valve and inject fuel, and discharging high pressure fuel inside the common rail supplied into the intermediate chamber into the fuel discharge passage so as to operate the booster piston and increase the fuel injection pressure, wherein an intermediate chamber control valve operated by the fuel pressure in the common rail is arranged in a fuel flow passage connecting the three-way valve and intermediate chamber, and said intermediate chamber control valve controls the flow area of the fuel flow passage in accordance with the fuel pressure in the common rail to operate the booster piston when the fuel pressure in the common rail is in a high pressure side fuel region higher than a predetermined fuel pressure and to weaken the booster action by the booster piston as compared with when the fuel pressure in the common rail is in the high pressure side fuel region or stop the operation of the booster piston when the fuel pressure in the common rail is in a low pressure side fuel region lower than the predetermined fuel pressure.

2. A fuel injection system as set forth in claim 1, wherein, when the fuel pressure in the common rail is in said high pressure side fuel region, said intermediate chamber control valve fully opens the flow path of said fuel flow passage when the fuel flow passage is connected to the fuel discharge passage by the switching action of the three-way valve, and when the fuel pressure in the common rail is in said low pressure side fuel region, said intermediate chamber control valve causes the flow path of said fuel flow passage to enable flow by exactly a flow area smaller than when fully opened or shuts said fuel flow passage when the fuel flow passage is connected to the fuel discharge passage by the switching action of the three-way valve.

3. A fuel injection system as set forth in claim 1, wherein said intermediate chamber control valve is provided with a valve chamber, a valve element moving back and forth in the valve chamber, and a high pressure chamber formed on one end face of the valve element in the axial direction and to which high-pressure fuel inside the common rail is guided, and when fuel pressure in the common rail changes and fuel pressure in said high pressure chamber changes, the valve element moves in the axial direction to change the passage area of the fuel flow passage.

4. A fuel injection system as set forth in claim 3, wherein said valve element is comprised of a first valve element and second valve element connected with each other in the axial direction spaced from each other and sliding on an inner circumferential face of the valve chamber, said high pressure chamber is formed on an outside end face of the first valve element, an end chamber is formed on an outside end face of the second valve element, an intervalve chamber is formed between the first valve element and second valve element, a three-way valve side fuel flow opening connected through the fuel flow passage to the three-way valve and an intermediate chamber side fuel flow opening connected through the fuel flow passage to the intermediate chamber are formed on the inner circumferential wall of the valve chamber, these fuel flow openings being connected with each other through the intervalve chamber, the connection of these fuel flow openings being cut off by closing at least one of these fuel flow openings by the second valve element.

5. A fuel injection system as set forth in claim 4, wherein said first valve element and second valve element have the same outside diameter, a spring member for biasing the first valve element and second valve element toward said high pressure chamber is inserted into said end chamber, when the fuel pressure in the common rail is in said high pressure side fuel region, said fuel flow openings are connected through the intervalve chamber to each other when the fuel flow passage is connected to the fuel discharge passage by the switching action of the three-way valve, while when the fuel pressure in the common rail is in said low pressure side fuel region, said both fuel flow openings are closed by the second valve element when the fuel flow passages is connected to the fuel discharge passage by the switching action of the three-way valve.

6. A fuel injection system as set forth in claim 4, wherein the first valve element has an outside diameter larger than the second valve element, high pressure fuel inside the common rail is introduced into said end chamber, a spring member for biasing the first valve element and second valve element toward said high pressure chamber is inserted into said end chamber, when the fuel pressure in the common rail is in said high pressure side fuel region, said fuel flow openings are connected through the intervalve chamber with each other when the fuel flow passage is connected to the fuel discharge passage by the switching action of the three-way valve, while when fuel pressure in the common rail is in said low pressure side fuel region, said both fuel flow openings are closed by the second valve element when the fuel flow passage is connected to the fuel discharge passage by the switching action of the three-way valve.

7. A fuel injection system as set forth in claim 6, wherein a fuel passage for sending high pressure fuel in the high pressure chamber into said end chamber is formed in said first valve element and second valve element.

8. A fuel injection system as set forth in claim 7, wherein a restricted opening is provided in said fuel passage.

9. A fuel injection system as set forth in claim 6, wherein restricted openings are provided in a high pressure fuel feed passage extending from the common rail to said high pressure chamber and a high pressure fuel feed passage extending from the common rail to said end chamber.

10. A fuel injection system as set forth in claim 6, wherein as the fuel pressure in the common rail becomes higher, the fuel flow openings opening into the intervalve chamber gradually increase in opening area and thereby as the fuel pressure in the common rail becomes higher, the booster action by the booster piston is strengthened.

11. A fuel injection system as set forth in claim 6, wherein said intermediate chamber is connected to the common rail through a restricted opening and a check valve enabling communication only from the common rail toward the intermediate chamber.

12. A fuel injection system as set forth in claim 6, wherein said end chamber is connected to the inside of a fuel flow passage leading from the intermediate chamber side fuel flow opening to the inside of the intermediate chamber.

13. A fuel injection system as set forth in claim 4, wherein the first valve element has an outside diameter larger than the second valve element, a high pressure fuel inside the common rail is introduced into said end chamber, a spring member biasing the first valve element and second valve element toward said high pressure chamber is arranged in said end chamber, said fuel flow passage extending from three-way valve side fuel flow opening to the three-way valve is constantly connected through a restricted opening with a flow area smaller than this fuel flow passage to the inside of the intervalve chamber, said intermediate chamber side fuel flow opening is made to constantly open to the intervalve chamber, when the fuel pressure in the common rail is in said high pressure side fuel region, the three-way valve side fuel flow opening is made to open to the inside of the intervalve chamber to make the booster piston operate when the fuel flow passage is connected to the fuel discharge passage by the switching action of the three-way valve, while when the fuel pressure in the common rail is in said low pressure side fuel region and at least when the fuel flow passage is connected to the fuel discharge passage by the switching action of the three-way valve, the three-way valve side fuel flow opening is closed by the second valve element to weaken the booster action by the booster piston compared with when the common rail pressure is in said high pressure side fuel region.

14. A fuel injection system as set forth in claim 4, wherein the first valve element has an outside diameter smaller than the second valve element, a spring member biasing the first valve element and second valve element toward said high pressure chamber is arranged in said end chamber, said fuel flow passage extending from three-way valve side fuel flow opening to the three-way valve is on the one hand constantly connected through a restricted opening with a flow area smaller than this fuel flow passage to the inside of the intervalve chamber and on the other hand is connected to said end chamber, said intermediate chamber side fuel flow opening is made to constantly open to the intervalve chamber, when fuel pressure in the common rail is in said high pressure side fuel region, the three-way valve side fuel flow opening is made to open into the intervalve chamber to make the booster piston operate when the fuel flow passage is connected to the fuel discharge passage by the switching action of the three-way valve, while when the fuel pressure in the common rail is in said low pressure side fuel region and the fuel flow passage is connected to the fuel discharge passage by the switching action of the three-way valve, the three-way valve side fuel flow opening is closed by the second valve element, and thereby the booster action by the booster piston is weakened compared with when the common rail pressure is in said high pressure side fuel region.

* * * * *